US008955835B2

(12) United States Patent
Satoh et al.

(10) Patent No.: US 8,955,835 B2
(45) Date of Patent: Feb. 17, 2015

(54) FEEDING DEVICE AND IMAGE FORMING APPARATUS

(71) Applicants: Hideyuki Satoh, Miyagi (JP); Masaki Ishizaki, Kanagawa (JP); Yousuke Edo, Kanagawa (JP); Takaya Ochiai, Kanagawa (JP)

(72) Inventors: Hideyuki Satoh, Miyagi (JP); Masaki Ishizaki, Kanagawa (JP); Yousuke Edo, Kanagawa (JP); Takaya Ochiai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/078,698

(22) Filed: Nov. 13, 2013

(65) Prior Publication Data

US 2014/0131938 A1 May 15, 2014

(30) Foreign Application Priority Data

Nov. 15, 2012 (JP) ..... 2012-251289

(51) Int. Cl.
*B65H 3/14* (2006.01)
*B65H 3/12* (2006.01)
*B65H 7/20* (2006.01)

(52) U.S. Cl.
CPC . *B65H 3/128* (2013.01); *B65H 7/20* (2013.01)
USPC ..... 271/98; 271/90; 271/94; 271/97; 271/34; 271/105

(58) Field of Classification Search
CPC ..... B65H 3/10; B65H 3/126; B65H 3/128; B65H 3/48; G06K 13/107
USPC ..... 271/90, 94, 97, 98, 105, 34, 152, 154, 271/155
See application file for complete search history.

(56) References Cited

U.S. PATENT DOCUMENTS

| | | | | |
|---|---|---|---|---|
| 5,645,274 | A * | 7/1997 | Ubayashi et al. | 271/94 |
| 7,458,570 | B2 | 12/2008 | Ueda et al. | |
| 2003/0080492 | A1* | 5/2003 | Nordling et al. | 271/94 |
| 2011/0187044 | A1* | 8/2011 | Utagawa et al. | 271/98 |
| 2012/0061903 | A1* | 3/2012 | Eguchi et al. | 271/18.1 |
| 2013/0168920 | A1* | 7/2013 | Shin et al. | 271/117 |

FOREIGN PATENT DOCUMENTS

| | | | | |
|---|---|---|---|---|
| JP | 63074841 | A * | 4/1988 | B65H 3/46 |
| JP | 10-297783 | | 11/1998 | |
| JP | 2001-247229 | | 9/2001 | |
| JP | 2007-045630 | | 2/2007 | |
| JP | 2012-025491 | | 2/2012 | |

* cited by examiner

*Primary Examiner* — Prasad Gokhale
(74) *Attorney, Agent, or Firm* — Harness, Dickey & Pierce PLC

(57) ABSTRACT

In the invention, after the last sheet is conveyed from a paper feed tray, the paper feed tray is lifted up so that the paper feed tray is brought into contact with a suction belt. An elastic cleaning member that removes paper particles, or the like, is installed at an area of the paper feed tray where the paper feed tray is in contact with the suction belt. The suction belt is driven while the cleaning member is in contact with the suction belt. The paper particles, or the like, removed from the suction belt by the cleaning member are collected in a paper-particle collecting device from a vacuum chamber via a vacuum duct.

20 Claims, 13 Drawing Sheets

FEEDING DEVICE AND IMAGE FORMING APPARATUS

CROSS-REFERENCE TO RELATED APPLICATIONS

The present application claims priority to and incorporates by reference the entire contents of Japanese Patent Application No. 2012-251289 filed in Japan on Nov. 15, 2012.

BACKGROUND OF THE INVENTION

1. Field of the Invention

The present invention relates to a feeding device that includes a suction conveying unit and that is installed in electrophotographic image forming apparatuses, such as copiers, printers, facsimile machines, or ink-jet printers, and relates to an image forming apparatus that includes the feeding device.

2. Description of the Related Art

Electrophotographic image forming apparatuses, such as copiers, include a feeding device. A bundle of sheet-like recording media (hereafter, simply referred to as "sheets"), such as papers or OHP films, is placed on a sheet placement unit, and the feeding device feeds the sheets one by one to a developing device. The feeding device includes a separation mechanism to separate the sheets from one another in order to prevent multi feeding, i.e., prevent a sheet from overlapping with another sheet when they are supplied.

A friction separation system is widely used in the separation mechanism, where a sheet conveyed from the sheet placement unit by a pick-up roller is separated and delivered due to a frictional force. In the friction separation system, the combination of a separation roller and a friction pad, the combination of a separation roller and a reverse roller, or the like, is used to separate sheets.

As the feeding devices that do not use the friction separation system, air-separation feeding devices described in, for example, Japanese Patent Application Laid-open No. 2001-247229 or Japanese Patent Application Laid-open No. 2007-45630 are known. In the air-separation feeding devices, when air is discharged to the bundle of sheets that is placed on the sheet placement unit in a stacked manner, the sheets are moved, floated, and separated from one another and thus the sheet located at the top sticks to a suction belt due to the suction force (negative pressure) while it is conveyed.

FIG. 12 illustrates the schematic configuration of an air-separation feeding device. An air-separation feeding device 301 illustrated in FIG. 12 includes a tray 302 on which a bundle of sheets P is placed; a front blower 303 and a side blower 304 that blow air to the upper front end and the upper side ends of the placed sheets P; and a rubber suction belt 305 that individually suctions and conveys the sheet P located at the top. The sheets P are aligned on the tray 302 depending on the size of the sheets P such that the front edge of the sheet P is brought into contact with a front fence 306 that is a reference plane.

In order to deliver the sheet P in the air-separation feeding device 301, the front blower 303 and the side blower 304 first blow air to the bundle of sheets P that is placed on the tray 302 so as to apply the air into the gap between the sheets P, whereby the sheets P are moved and floated up to a height h of the suction belt 305. The sheet P1 that is located at the top of the floated sheets sticks to the suction belt 305 and, in this state, the suction belt 305 is rotated so that the sheet P1 is conveyed to an undepicted image forming unit for image formation.

The air-separation feeding devices described in Japanese Patent Application Laid-open No. 2001-247229 and Japanese Patent Application Laid-open No. 2007-45630 include an upper-surface position detection unit that detects the position of the uppermost surface of the placed sheets. The upper-surface position detection unit includes, for example, an actuator 310 that is illustrated in FIG. 12 and is swingably brought into contact with by a fore-end 312 thereof the uppermost surface of the bundle of sheets; and a swing detection sensor 311 that detects swing of the actuator 310. The actuator 310 is installed in a position close to the suction belt 305 so as to keep the target distance h with a stabile accuracy regardless of the size of sheets.

When the height of the bundle of sheets is decreased after a sheet is delivered, the actuator 310 is accordingly swung. The swing detection sensor 311 then detects the degree of swing of the actuator 310 and, in accordance with the detection signal, a bottom plate 302*a* of the tray 302 is lifted up by an undepicted lifting unit so that the height (distance) h from the upper surface of the bundle of sheets to the suction belt 305 is controlled to be constant.

If paper particles, or the like, of sheets adhere to the surface of the suction belt 305 due to long-term usage, the suction force of the suction belt 305 is decreased and thus improper feeding (no feeding) sometimes occurs. The foreign matter that adheres to the suction belt 305 includes not only paper particles and a loading material of papers but also components of a coating material of coated papers, powders for reprint papers (blocking powders in order to prevent an image from being transferred to the back side of a sheet on which offset printing has been performed), or the like.

(1) in order to remove foreign matter from the suction belt, it is possible that, for example, a brush or scraper is pressed against the suction belt, as described in Japanese Patent Application Laid-open No. 2012-25491, Japanese Patent Application Laid-open No. 10-297783, or the like. However, there is a higher possibility that, if the removed foreign matter adheres to the sheet that is to be delivered, images are improperly formed due to the foreign matter or the foreign matter is mistakenly detected as a sheet; thus, a sheet jam, or the like, occurs.

(2) if a foreign-matter removing member, such as a brush or scraper, is always in contact with the suction belt, the suction belt is abraded due to the contact with the foreign-matter removing member, or the drive resistance of the suction belt is increased. Furthermore, if the foreign-matter removing member is in contact with the suction belt for a moment, a removing operation is not performed in a stable manner.

(3) if the foreign-matter removing member is installed in the feeding device, the costs are increased. Furthermore, if the feeding device does not have any space for installing the foreign-matter removing member, it is difficult to install the foreign-matter removing member.

(4) There is a possibility that, even if foreign matter is removed from the suction belt, the foreign matter adheres to the sheet again or the foreign matter has effects in another way (e.g., the foreign matter is mistakenly detected as a sheet).

(5) if it takes too long to remove foreign matter from the suction belt, the printing productivity is decreased.

(6) If the foreign-matter removing member is deteriorated, the foreign-matter removal performance is decreased; therefore, the foreign-matter removing member needs to be replaced on a regular basis. However, in some configurations where the foreign-matter removing member is installed in the feeding device, it is inconvenient to replace the foreign-matter removing member; thus, the printing productivity and the user convenience are further decreased.

(7) Even if the foreign matter removed from the suction belt is discharged into a place that does not affect image formation, an area near the discharge place is contaminated with foreign matter.

(8) If the frequency at which the cleaning mode of the suction belt is performed is manually increased or decreased to the minimum required frequency in order to improve the printing productivity, and if the frequency is unexpectedly lower than the minimum frequency, the amount of foreign matter, such as paper particles, that adheres to the suction belt is continuously increased; thus, there is a higher possibility that the above-described failures, such as improper images or sheet jams, occur.

(9) In a case where the frequency at which the operation to remove foreign matter is performed is automatically set to the minimum required frequency, i.e., the operation to remove foreign matter is performed each time a predetermined number of sheets are supplied, there is a possibility that, if the setting is not appropriate, a properly cleaned state cannot be obtained. Furthermore, as the abrasion or degradation of the suction belt or the foreign-matter removing member is inevitable, it is necessary to gradually decrease the above-described set number of sheets with time instead of fixing the number.

The present invention has been made in consideration of the foregoing problem and has an object to reduce the abrasion of the suction belt, which is a suction conveying unit, and loss of the drive force of the suction belt, to ensure that paper particles removed from the suction belt are captured and collected without being scattered around the area, and to prevent the paper particles from adhering to the suction belt or the sheet again. The other objects of the present invention are explained with reference to the embodiment described below.

SUMMARY OF THE INVENTION

It is an object of the present invention to at least partially solve the problems in the conventional technology.

According to the present invention, there is provided: a feeding device comprising: a sheet placement unit configured to place sheets in stacked state thereon; an air discharge unit configured to discharge air to the sheets so as to float a single sheet that is located at top of the sheets; a suction conveying unit configured to suction, due to a negative pressure, the single floated sheet located at the top of the sheets and conveys the sheet; an upper-surface position detection unit configured to be brought into contact with an uppermost surface of the sheets so as to detect a level the uppermost surface; a lifting and lowering unit configured to lift and lower the sheet placement unit in a vertical direction; and a control unit configured to control, in accordance with an uppermost surface position detected by the upper-surface position detection unit, the lifting and lowering unit such that a level of the uppermost surface of the sheets becomes a predetermined level, wherein the suction conveying unit is driven in a state where the sheet placement unit is in contact with the suction conveying unit.

The present invention also provides an image forming apparatus including a feeding device, wherein the feeding device comprises: a sheet placement unit configured to place sheets in stacked state thereon; an air discharge unit configured to discharge air to the sheets so as to float a single sheet that is located at top of the sheets; a suction conveying unit configured to suction, due to a negative pressure, the single floated sheet located at the top of the sheets and conveys the sheet; an upper-surface position detection unit configured to be brought into contact with an uppermost surface of the sheets so as to detect a level the uppermost surface; a lifting and lowering unit configured to lift and lower the sheet placement unit in a vertical direction; and a control unit configured to control, in accordance with an uppermost surface position detected by the upper-surface position detection unit, the lifting and lowering unit such that a level of the uppermost surface of the sheets becomes a predetermined level, wherein the suction conveying unit is driven in a state where the sheet placement unit is in contact with the suction conveying unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
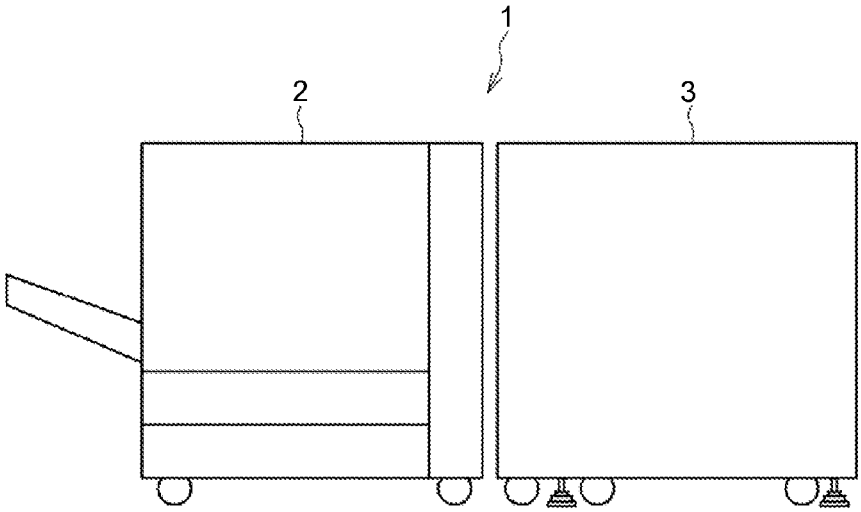
FIG. 1 is an external view illustrating an embodiment of an image forming apparatus that includes a feeding device according to the present invention.

An exemplary embodiment of a feeding device according to the present invention is explained in detail below with reference to the accompanying drawings. In the drawings that are used to explain the embodiment, the same reference numerals and codes are applied to components, i.e., constituent parts or members, that have the same function or configuration as long as they can be distinguished from one another, and after they are explained once, the explanations thereof are omitted.

Image Forming Apparatus

FIG. 1 is an external view illustrating an embodiment of an image forming apparatus that includes a feeding device according to an embodiment of the present invention.

As illustrated in FIG. 1, an image forming apparatus 1 includes an image forming apparatus main body 2 and a feeding device 3 that is connected to one side of the image forming apparatus main body 2 so as to feed sheets to the image forming apparatus main body 2.

Figure 2:
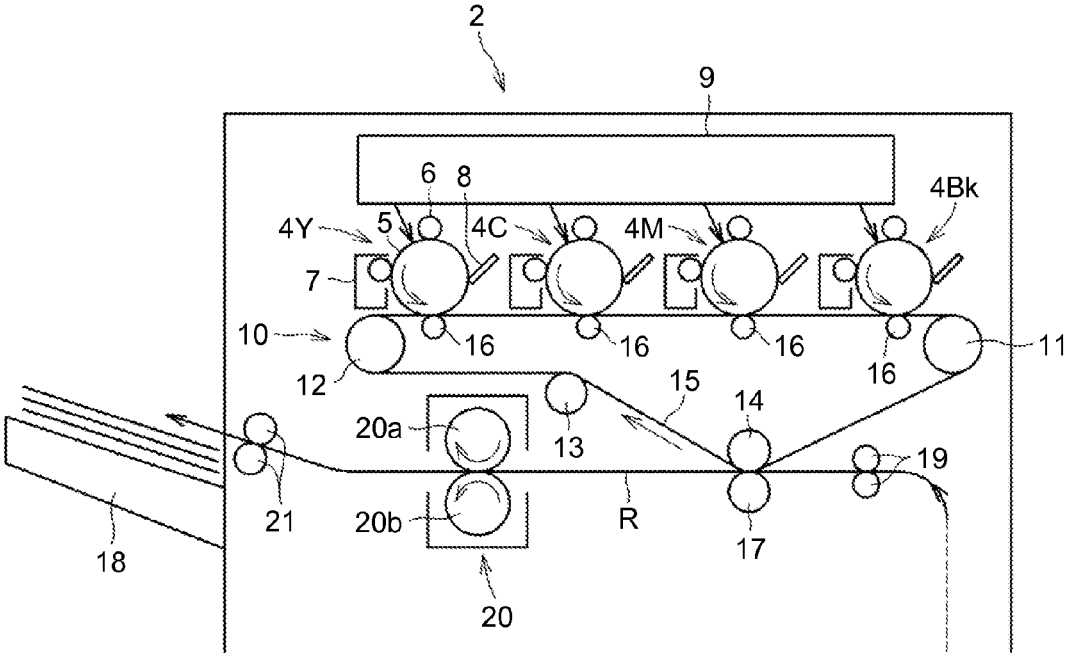
FIG. 2 is a schematic configuration diagram of an image forming apparatus main body.

FIG. 2 is a schematic configuration diagram of the image forming apparatus main body 2.

As illustrated in FIG. 2, the image forming apparatus main body 2 includes four process units 4Y, 4C, 4M, and 45*k*. Each of the process units 4Y, 4C, 4M, and 4Bk is configured to be attached to or detached from the image forming apparatus main body 2. The process units 4Y, 4C, 4M, and 4Bk have the same configuration except that they contain toner of different colors, i.e., yellow, cyan, magenta, and black, that correspond to the color separation components of a color image.

Specifically, each of the process units 4Y, 4C, 4M, and 4Bk includes a photosensitive element 5 that is an electrostatic latent image carrier; a charge roller 6 that is a charge unit that charges the surface of the photosensitive element 5; a developing device 7 that is a developing unit that forms a toner image on the surface of the photosensitive element 5; and a cleaning blade 8 that cleans the surface of the photosensitive element 5.

As illustrated in FIG. 2, an exposure device 9 that is an exposure unit is installed above the process units 4Y, 4C, 4M, and 4Bk. The exposure device 9 is configured to emit laser light to the photosensitive element 5 of each of the process units 4Y, 4C, 4M, and 4Bk.

Furthermore, a transfer device 10 is installed below the process units 4Y, 4C, 4M, and 4Bk. The transfer device 10 includes an intermediate transfer belt 15 that is an endless belt wrapped around a plurality of rollers 11 to 14. The intermediate transfer belt 15 is configured to move around in the direction indicated by the arrow illustrated in FIG. 2 when one of the rollers 11 to 14 is rotated as a drive roller.

Four primary transfer rollers 16 that are primary transfer units are provided at the positions where they are opposed to the four photosensitive elements 5. Each of the primary transfer rollers 16 is pressed against the inner circumference of the intermediate transfer belt 15 at a corresponding position so that a primary transfer nip is formed at an area where the pressed area of the intermediate transfer belt 15 is in contact with the photosensitive element 5. Moreover, a secondary transfer roller 17 that is a secondary transfer unit is provided at a position where it is opposed to the roller 14 around which the intermediate transfer belt 15 is wrapped. The secondary transfer roller 17 is pressed against the outer circumference of the intermediate transfer belt 15 so that a secondary transfer nip is formed at the area where the secondary transfer roller 17 is in contact with the intermediate transfer belt 15.

A conveyance path R is installed within the image forming apparatus main body 2 to guide the sheet fed by the feeding device 3 to a discharge tray 18, which is provided outside the apparatus, through the secondary transfer nip. Timing rollers 19 are located upstream of the secondary transfer roller 17 in the sheet conveying direction on the conveyance path R. A fixing device 20 is located downstream of the secondary transfer roller 17 in the sheet conveying direction. Furthermore, a pair of discharge rollers 21 is located downstream of the fixing device 20 in the sheet conveying direction.

The fixing device 20 includes a heating roller 20*a* that has a heat source therein and includes a pressing roller 20*b* that applies pressure to the heating roller 20*a*. The heating roller 20*a* and the pressing roller 20*b* are in contact with and are pressed against each other so that a fixing nip is formed at the contact area therebetween.

An explanation is given below, with reference to FIG. 2, of a basic operation of the image forming apparatus.

The photosensitive element 5 of each of the process units 4Y, 4C, 4M, and 4Bk is driven and rotated in a counterclockwise direction of FIG. 2, and the surface of the photosensitive element 5 is uniformly charged by the charge roller 6 so that it has a predetermined polarity. The charge roller 6 emits laser light to the charged surface of the photosensitive element 5 on the basis of the image information on the original document that is read by an undepicted read device, whereby an electrostatic latent image is formed on the surface of the photosensitive element 5. Here, the image information for exposure of each of the photosensitive elements 5 is single-color image information that is obtained by separating a desired full-color image into color information on yellow, cyan, magenta, and black. Toner is supplied to the electrostatic latent image formed on the photosensitive element 5 by the developing device 7 so that the electrostatic latent image is developed as a toner image.

One of the rollers that are pressed against the intermediate transfer belt 15 is driven and rotated so that the intermediate transfer belt 15 is moved around in the direction indicated by the arrowed line illustrated in FIG. 2. Furthermore, a constant voltage that has a polarity opposite to that of the charged toner or a voltage on which constant current control is performed is applied to each of the primary transfer rollers 16, whereby a transfer electric field is formed at the primary transfer nip between the primary transfer roller 16 and the photosensitive element 5. The toner image of each color formed on each of the photosensitive elements 5 is sequentially transferred to the intermediate transfer belt 15 in a superimposed manner due to the transfer electric field formed at the above-described primary transfer nip.

Thus, the intermediate transfer belt 15 carries the full-color toner image on its surface. Furthermore, some toner has not been transferred onto the intermediate transfer belt 15 and thus remains on the surface of the photosensitive element 5 after the transfer. The toner remaining on the photosensitive element 5 is removed by the cleaning blade 8.

A sheet is delivered from the feeding device 3 illustrated in FIG. 1, and the delivered sheet is conveyed to the secondary transfer nip between the secondary transfer roller 17 and the intermediate transfer belt 15 at an appropriate timing by the timing rollers 19. At this time, the transfer voltage having a polarity opposite to that of the charged toner of the toner image formed on the intermediate transfer belt 15 is applied to the secondary transfer roller 17; thus, a transfer electric field is formed at the secondary transfer nip. The toner images formed on the intermediate transfer belt 15 are collectively transferred onto the sheet due to the transfer electric field formed at the secondary transfer nip.

The sheet onto which the toner images have been transferred is conveyed to the fixing device 20. In the fixing device 20, the sheet is sandwiched between the heating roller 20*a* and the pressing roller 20*b* so that the sheet is heated and pressed, whereby the toner images are fixed to the sheet. Afterward, the sheet is discharged into the discharge tray 18 by the pair of discharge rollers 21.

In the above explanation, an image forming operation is performed to form a full-color image on a sheet; however, it is possible to form a single-color image by using any one of the four process units 4Y, 4C, 4M, and 4Bk or form an image of two or three colors by using two or three process units.

Feeding Device

Figure 3:
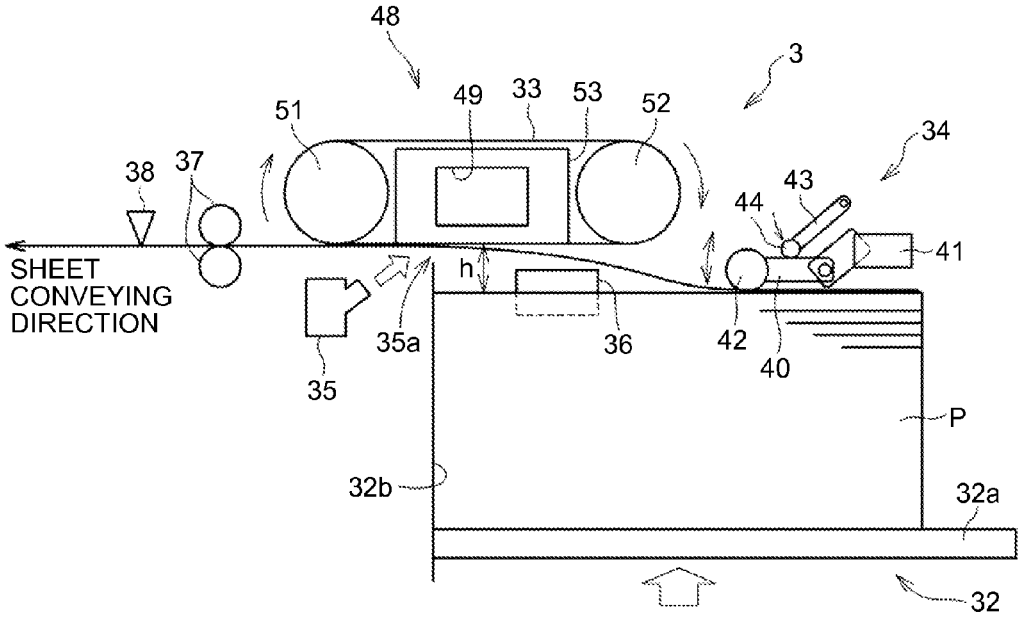
FIG. 3 is a schematic configuration diagram of the overall feeding device.

As illustrated in the schematic configuration diagram of FIG. 3, the feeding device according to an embodiment of the present invention includes a paper feed tray 32 serving as a sheet placement unit configured to have a bundle of sheets P placed thereon; a suction belt 33 of a suction conveying unit that conveys a sheet; an upper-surface position detection device 34 serving as an upper-surface position detection unit that detects the position of the upper surface of the bundle of sheets placed; a lifting and lowering motor 47 (see FIG. 4) of a paper feed tray bottom plate 32*a* that lifts the bundle of sheets in accordance with a detection result of the upper-surface position detection device 34 so that the level of the uppermost surface of the bundle reaches a predetermined level; a front blower 35 and a side blower 36 that serve as an air discharge unit that discharges air to the bundle of sheets placed so as to float a single sheet that is located at the top of the bundle; a pair of carriage rollers 37 that is located downstream of the suction belt 33 in the sheet conveying direction; and a sheet detection sensor 38 that is located further downstream. As illustrated in FIG. 3, a front air discharge opening 35*a* is provided at the vicinity of the upper section of a front fence 32*b*.

The upper-surface position detection device 34 includes an actuator 40, a photo sensor 41, a pressing roller 42 that is a pressing member, a biasing lever 43 and a biasing roller 44 serving as a biasing unit.

The paper feed tray 32 is configured to be pulled out to the front side when an undepicted front door of the feeding device 3 is open. When the paper feed tray 32 is pulled out from the feeding device 3, the sheets in the paper feed tray 32 can be replaced with another sheets or the paper feed tray 32 can be refilled with sheets. Sheets P that can be stacked on the paper feed tray 32 include heavy sheets, postcards, envelopes, regular sheets, thin sheets, painting sheets (coated sheets, art sheets, or the like), tracing sheets, or the like. The feeding device according to an embodiment of the present invention is configured to feed sheet-like recording media, such as OHP sheets or OHP films, other than papers.

Figure 4:
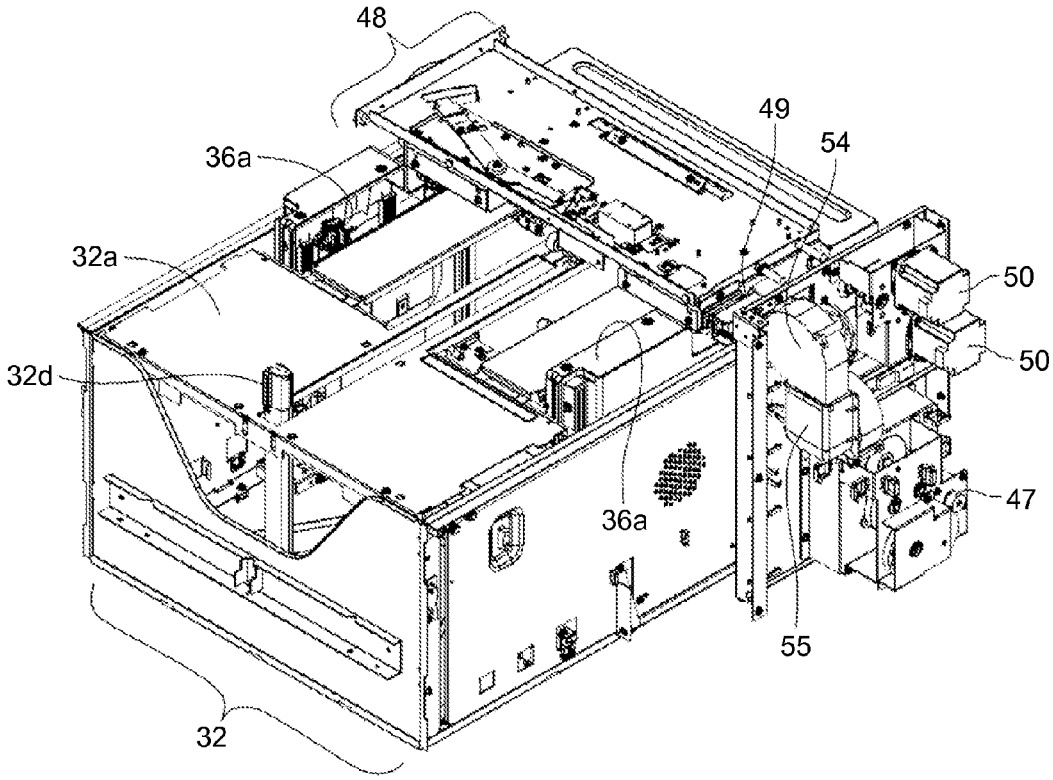
FIG. 4 is a diagrammatic perspective view illustrating a configuration of the feeding device.

As illustrated in FIGS. 4 to 7, the paper feed tray 32 is shaped like an open-topped box. The paper feed tray 32 includes the bottom plate 32*a*; the front fence 32*b* that sets the position of the front end of the bundle of sheets placed on the bottom plate 32*a* in a conveying direction; a pair of side fences 32*c* that sets the positions of both ends of the bundle of sheets in a width direction (a direction perpendicular to the conveying direction); and an end fence 32*d* that sets the position of the rear end of the bundle of sheets in the conveying direction. Sheets are replaced or supplied from above the paper feed tray 32. As illustrated in FIG. 4, the bottom plate 32*a* is configured to be lifted and lowered in a vertical direction by the tray bottom-plate lifting and lowering motor 47 serving as a lifting and lowering unit installed on the lower side surface of the paper feed tray 32.

Figure 8:
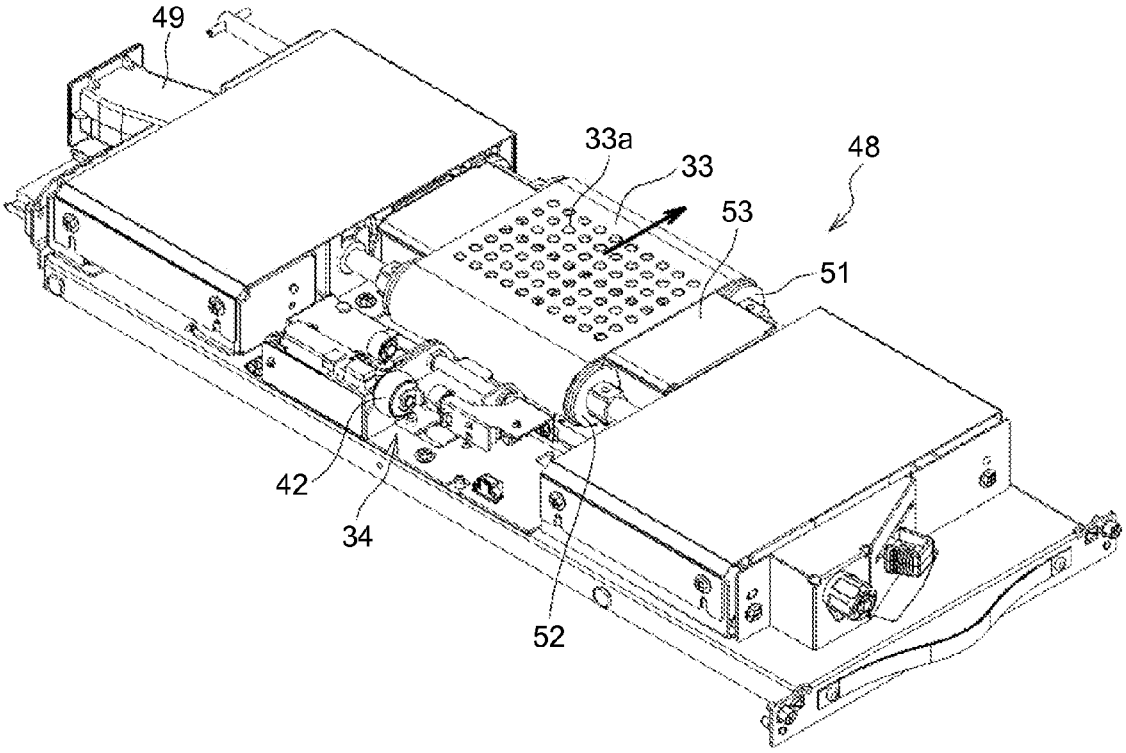
FIG. 8 is a diagrammatic perspective view of the suction conveying unit of FIG. 4 alone when viewed from beneath.

A suction conveying unit 48 that includes the suction belt 33, and the like, is mounted on the top of the paper feed tray 32 beside the front fence 32*b*, and the suction conveying unit 48 is arranged such that it crosses the paper feed tray 32, i.e., it is extended between the side fences 32*c*. As illustrated in FIG. 8, when viewed from underneath, the suction conveying unit 48 includes the suction belt 33, a vacuum duct 49 that connects the suction conveying unit 48 to an undepicted vacuum blower, and the upper-surface position detection device 34.

The suction belt 33 is extended between a drive roller 51 and a driven roller 52 while a predetermined tensional force is applied thereto. The drive roller 51 is connected to a drive motor 50 that is a drive unit and is illustrated in FIG. 4 and, when the drive motor 50 is driven at a predetermined feed timing, the drive roller 51 is driven and rotated so that the suction belt 33 is rotated in the direction indicated by the arrowed line in FIG. 3.

A box-like vacuum chamber 53 is provided between the drive roller 51 and the driven roller 52 and is in the area surrounded by the suction belt 33. A plurality of downward (upward in FIG. 8) openings is formed on the vacuum chamber 53. As illustrated in FIG. 4, the vacuum chamber 53 is connected to a vacuum blower 54 via the vacuum duct 49.

When the vacuum blower 54 is driven so that air is vacuumed out of the vacuum chamber 53 via the vacuum duct 49, a negative pressure is produced inside the vacuum chamber 53. Thus, air is vacuumed through a plurality of suction holes 33*a* that is formed on the suction belt 33 so that a sheet sticks to the outer surface (the lower surface) of the suction belt 33 due to the vacuumed air.

Furthermore, as illustrated in FIG. 4, a paper-particle collecting device 55 is connected to an exhaust air passage that is located downstream of the vacuum blower 54 so that paper particles, or the like, contained in the exhaust air from the vacuum blower 54 can be collected and accumulated in the paper-particle collecting device 55. The collected and accumulated paper particles, and the like, can be taken out and disposed by replacing the cassette, or the like, appropriately on a regular basis or on an as-needed basis. Thus, there is no possibility that the collected paper particles, or the like, are scattered around the area.

Figure 5:
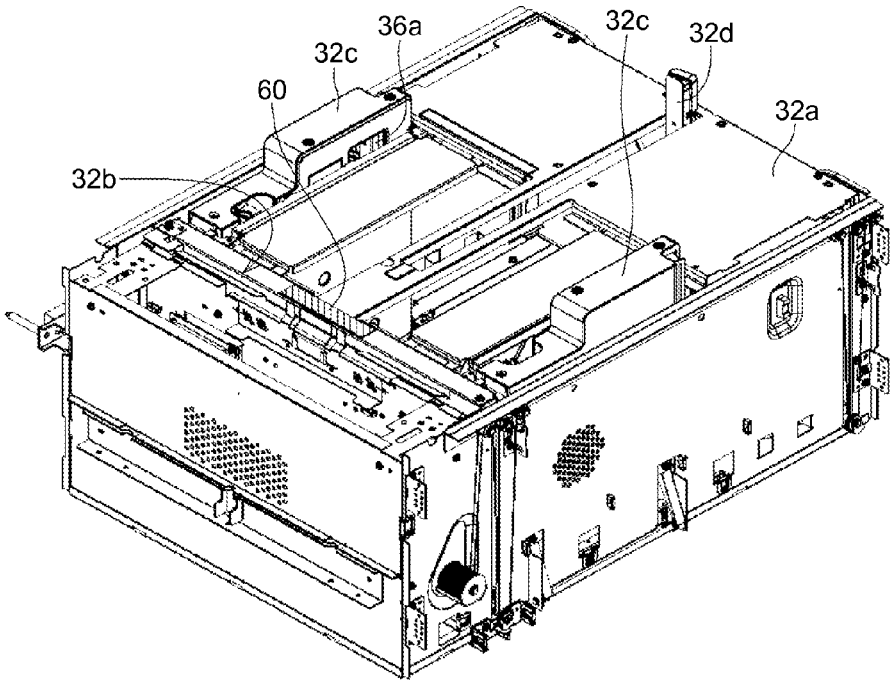
FIG. 5 is a diagrammatic perspective view of the feeding device of FIG. 4 from which a suction conveying unit is removed, when viewed in a different direction.
Figure 6:
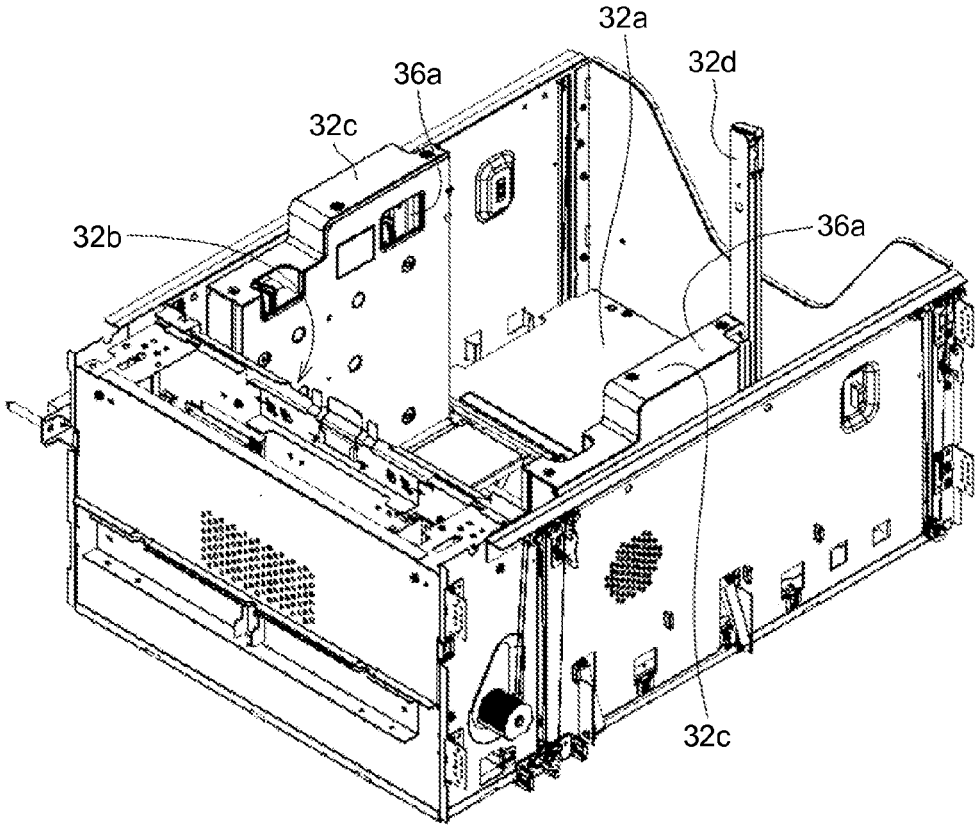
FIG. 6 is a diagrammatic perspective view illustrating a state where a tray bottom plate of the feeding device of FIG. 5 is lowered to a lowermost section.
Figure 7:
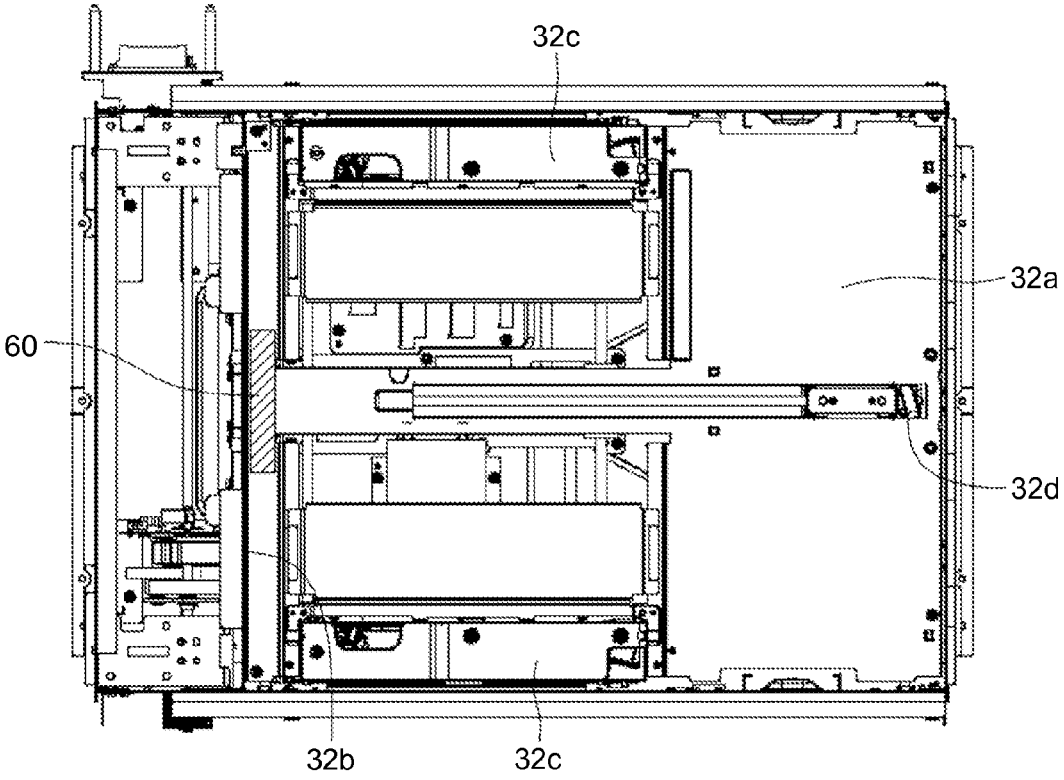
FIG. 7 is a plan view of the feeding device of FIG. 6.

FIGS. 4 and 5 illustrate a state where the sheets are removed and the paper feed tray bottom plate 32*a* is lifted up to the feed uppermost section, and FIGS. 6 and 7 illustrate a state where the sheets are removed and the paper feed tray bottom plate 32*a* is lowered to the feed lowermost section. Furthermore, the right-and-left side fences 32*c* illustrated in FIGS. 4 to 7 are in a state such that they are pulled apart so as to have the maximum possible size for stacking.

As illustrated in FIGS. 5 and 7, a cleaning member 60 is attached to the top of the edge of the tray bottom plate 32*a* on the downstream side to remove paper particles, or the like, that adhere to the suction belt 33 of the suction conveying unit 48. The cleaning member 60 may be made up of, for example, a non-woven cloth, brush, blade, or the like, that is secured to the tray bottom plate 32*a*. The cleaning member 60 may be formed into any shape by using a material that is suitable for removing paper particles, or the like. In the illustrated example, the cleaning member 60 is formed into a band-like shape that extends for a predetermined distance in the width direction of the tray bottom plate 32*a*. Thus, it is possible to clean a wider area of the suction belt 33 by using the small cleaning member 60.

Furthermore, the cleaning member 60 may be secured to the tray bottom plate 32*a* by using any appropriate method, such as glueing or magnetic attraction. As the cleaning member 60 needs to be replaced due to time degradation, the cleaning member 60 may be secured by using a structure by which it can be easily replaced (can be attached or removed). If the cleaning member 60 is replaced on a regular basis, the cleaning capability can be maintained.

In order not to damage the suction belt 33, the cleaning member 60 may have an appropriate degree of elasticity and stiffness. If a blade that has an appropriate degree of elasticity and stiffness is used, it is possible to easily scrape the paper particles, or the like, that stick to the suction belt 33. The blade may be in contact with the suction belt 33 in a counter or trailing direction. Furthermore, a rotary brush may be used as the cleaning member 60; thus, the load on the suction belt 33 can be reduced. Moreover, the opposing area of the vacuum chamber 53 that is opposed to the cleaning member 60 may be formed of an elastic material or low-friction material. Thus, the load on the suction belt 33 during cleaning can be reduced.

FIG. 5 illustrates a state where the suction conveying unit 48 is removed from the feeding device illustrated in FIG. 4. A pair of side air discharge openings 36*a* is provided on the upper sections of the two side fences 32*c*, as illustrated in FIG. 6. Each of the discharge openings 36*a* is connected to the front blower 35 and the side blower 36, which are installed within each fence, via an undepicted duct. The air discharged through each of the discharge openings 36*a* is blown to the upper layer of the bundle of sheets placed on the paper feed tray 32.

The pressing roller 42 is in contact with the uppermost surface of the bundle of sheets and, when a sheet is supplied and thus the level of the uppermost surface of the bundle of sheets is lowered, the actuator 40 is accordingly swung. The photo sensor 41 is configured to detect the displacement of the actuator 40 due to the swing. Furthermore, a configuration is such that, in accordance with the detection signal of the photo sensor 41, the tray bottom-plate lifting and lowering motor 47 illustrated in FIG. 4 causes the bottom plate 32*a* of the paper feed tray 32 to be lifted up so that the height h (see FIG. 3) from the uppermost surface of the bundle of sheets to the suction belt 33 is kept at a predetermined height.

Feeding Operation

Next, an explanation is given of a feeding operation performed by the feeding device.

When a feed command is issued by the image forming apparatus main body 2, the blower (the front blower 35 and the side blower 36) discharges air to the upper sheet in the bundle of sheets stacked and, at the same time, the air vacuum of the suction belt 33 is started. Thus, the first sheet that is located at the top of the bundle of sheets is separated from the second and subsequent sheets and the first sheet is floated up to the height h of the suction belt 33, whereby the first sheet sticks to the lower surface of the suction belt 33. The rotation of the suction belt 33 and the carriage rollers 37 are then started while the first sheet sticks to the suction belt 33 so that the first sheet is conveyed.

Afterward, when the first sheet reaches the sheet detection sensor 38 illustrated in FIG. 3 so that the first sheet is detected, the rotation of the suction belt 33 is stopped. The carriage rollers 37 continuously convey the sheet while the suction belt 33 is stopped. The pressing roller 42 of the actuator 40 is brought into contact with the upper surface of the second sheet so that the position of the upper surface of the bundle of sheets is detected. If the position of the upper surface is lower than a predetermined reference height in accordance with the detection result of the upper surface position of the bundle of sheets, the tray bottom-plate lifting and lowering motor 47 causes the bottom plate 32*a* of the paper feed tray 32 to be lifted up. Thus, height adjustment is performed such that the height (distance) h from the upper surface of the bundle of sheets to the suction belt 33 becomes a predetermined value. Furthermore, if the detected position of the upper surface of the bundle of sheets is not lower than the predetermined reference height, height adjustment is not performed.

Figure 9A:
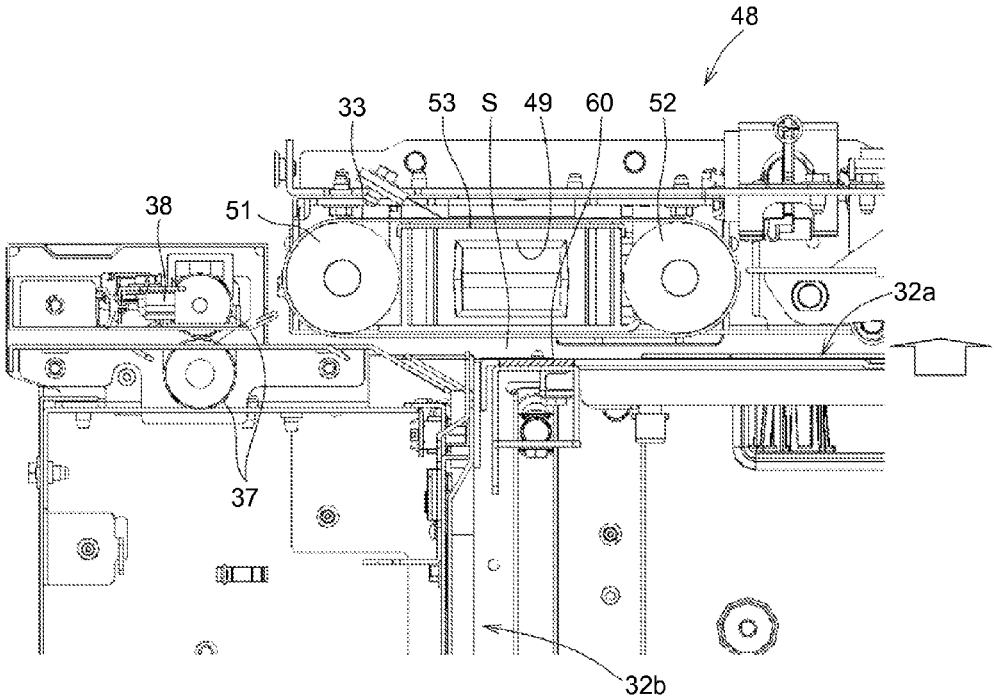
FIG. 9A is a cross-sectional view of a relevant part in a state where the paper feed tray bottom plate of the feeding device is lifted up to a feeding end position.

FIG. 9A is an enlarged view of the suction conveying unit 48 when the conveyance of the last sheet from the paper feed tray 32 has been completed. The suction belt 33 is wrapped around the drive roller 51 and the driven roller 52, and the position of the paper feed tray bottom plate 32*a* is set in a state where the last sheet has been conveyed. When the last sheet has been conveyed, a space S that is suitable for vacuum conveyance is formed between the paper feed tray bottom plate 32*a* and the suction conveying unit 48.

Figure 9B:
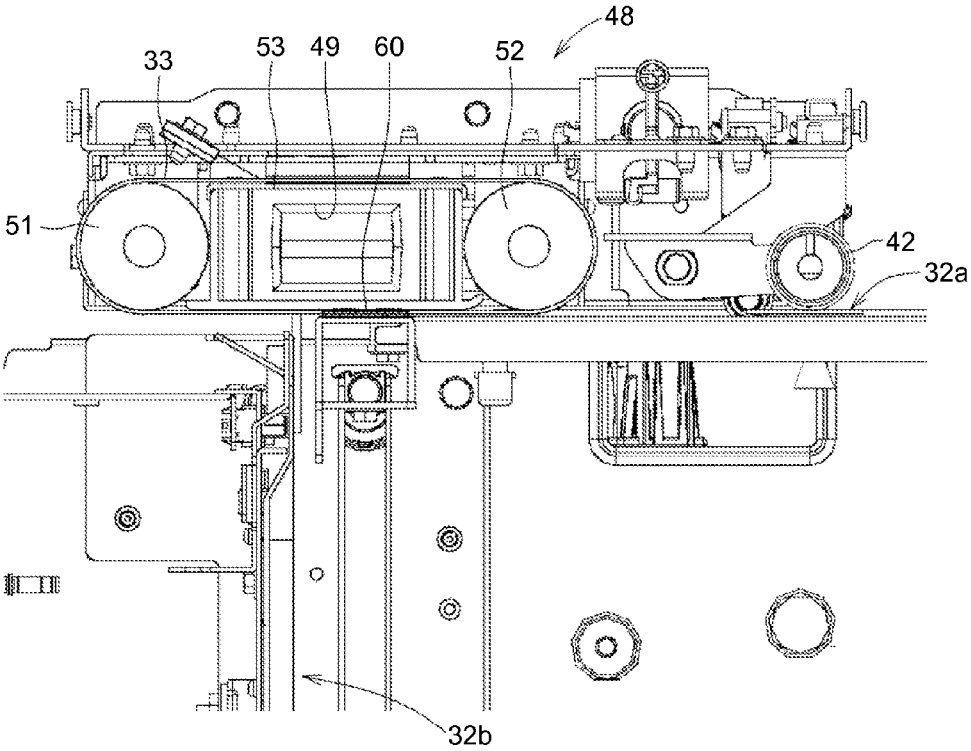
FIG. 9B is a cross-sectional view of a relevant part in a state where the paper feed tray bottom plate of the feeding device is lifted up to the uppermost position during a cleaning mode for a suction belt.

FIG. 9B illustrates a state where, after the last sheet has been conveyed, the paper feed tray bottom plate 32*a* is lifted up so that the space S becomes smaller, and the cleaning member 60 that removes paper particles, or the like, is in contact with the suction conveying unit 48. In this state, the suction belt 33 of the suction conveying unit 48 is rotated so that the cleaning member 60 removes paper particles, or the like, from the suction belt 33. The removed paper particles, or the like, are drawn into the vacuum chamber 53 through the suction holes 33*a* of the suction belt 33 due to the negative pressure in the vacuum chamber 53.

As described above, according to the present embodiment, if the cleaning member 60 is attached to a conventional air-separation feeding device by using an appropriate method, such as glueing, the suction belt 33 can be cleaned without moving the cleaning member 60 itself. Therefore, there is no need to additionally install a complicated cleaning member in a conventional device, and a feeding device that has a cleaning mode can be obtained in a very easy manner, within a smaller space, and at lower costs.

Figure 10:
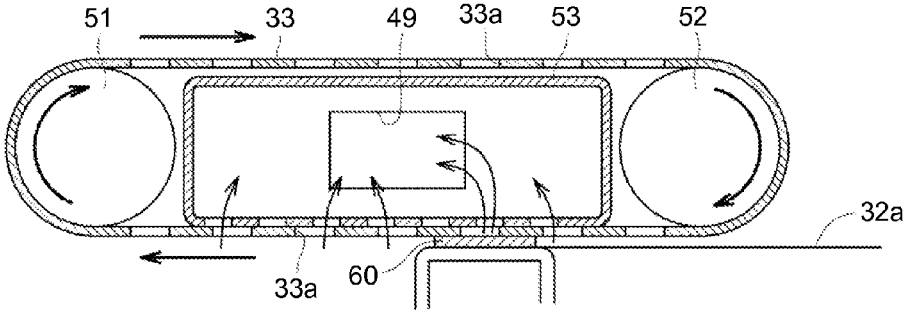
FIG. 10 is a schematic view of a relevant part of the feeding device during a cleaning mode.

FIG. 10 illustrates the flow of air when the paper particles, or the like, removed from the suction belt 33 by the cleaning member 60 are drawn into the vacuum chamber 53 through the suction holes 33*a* of the suction belt 33 due to the negative pressure in the vacuum chamber 53. As illustrated in FIG. 10, as the suction belt 33 slides on the upper surface of the cleaning member 60 and is moved around, the paper particles, or the like, that adhere to the lower surface of the suction belt 33 are scraped by the cleaning member 60. The removed paper particles, or the like, are drawn into the inside of the vacuum chamber 53 through the holes thereof due to the negative pressure, and they are collected and accumulated in the paper-particle collecting device 55, which is located outside the apparatus, via the vacuum duct 49.

Figure 11:
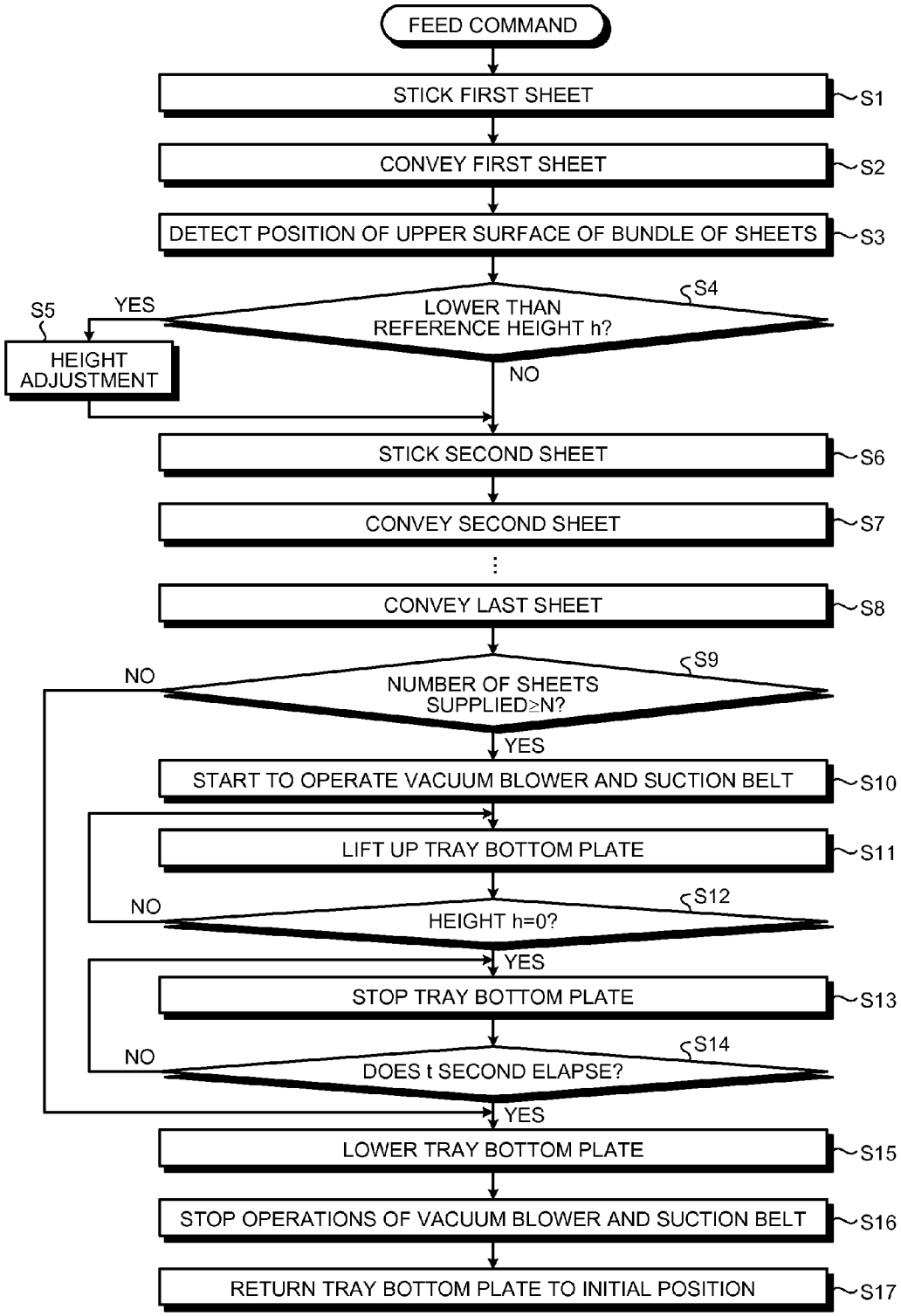
FIG. 11 is a flowchart that illustrates feeding of the feeding device and belt cleaning control.

FIG. 11 is a flowchart of a control device that controls the upper-surface position detection device 34, the tray bottom-plate lifting and lowering motor 47, the drive motor 50 of the suction belt 33, the vacuum blower 54, and the like. As illustrated in FIG. 11, when a feed command is issued by the image forming apparatus main body 2, the front blower 35 and the side blower 36 discharge air toward the upper sheet in the bundle of sheets stacked so as to suction the first sheet. At the same time, the vacuum blower 54 is driven so that air vacuum of the suction belt 33 is started.

Therefore, the first sheet that is located at the top of the bundle of sheets is separated from the second and subsequent sheets and the first sheet is floated up to the height h of the suction belt 33, whereby the first sheet sticks to the lower surface of the suction belt 33 (Step S1). The rotation of the suction belt 33 and the carriage rollers 37 are then started while the first sheet sticks to the suction belt 33 so that the first sheet is conveyed (Step S2).

Afterward, when the first sheet reaches the sheet detection sensor 38 illustrated in FIG. 3 so that the first sheet is detected, the rotation of the suction belt 33 is stopped. The carriage rollers 37 continuously convey the sheet while the suction belt 33 is stopped. In this state, the position of the upper surface of the bundle of sheets is detected (Step S3). If the position of the upper surface is lower than a predetermined reference height in accordance with the detection result of the upper surface position of the bundle of sheets (YES at Step S4), the tray bottom-plate lifting and lowering motor 47 causes the bottom plate 32*a* of the paper feed tray 32 to be lifted up. Thus, height adjustment is performed such that the height (distance) h from the upper surface of the bundle of sheets to the suction belt 33 becomes a predetermined value (Step S5).

If the detected position of the upper surface of the bundle of sheets is not lower than the predetermined reference height (NO at Step S4), height adjustment is not performed. Immediately after the first sheet passes through the vacuum area of the suction belt 33, the second sheet is separated and floated up due to the air discharged from the front blower 35 and the side blower 36 and due to the air vacuum of the suction belt 33, whereby the second sheet sticks to the suction belt 33 (Step S6). Afterward, the rotation of the suction belt 33 is started again in accordance with a predetermined feeding interval so that the second sheet is conveyed (Step S7). Subsequently, the same feeding operation is repeatedly performed so that the sheets are sequentially supplied to the image forming apparatus main body.

After the last sheet has been conveyed from the paper feed tray 32 (Step S8), it is determined whether or not the number of sheets supplied after the previous cleaning operation is equal to or larger than N (Step S9). If the number of sheets is fewer than N (NO sy Step S9), the paper feed tray bottom plate 32*a* is lowered to the lowermost section as illustrated in FIG. 6 so as to stand by for the next sheet supply (Step S15).

If it is determined that the number of sheets supplied after the previous cleaning operation is equal to or larger than N (YES at Step S9), the vacuum blower 54 is driven (Step S10). And, the paper feed tray bottom plate 32*a* is further lifted up from the position illustrated in FIG. 9A (Step S11). If the paper feed tray bottom plate 32*a* is lifted up to a level where it is in contact with the suction belt 33 (Step S12), the lifting of the paper feed tray bottom plate 32*a* is stopped (Step S13). In this state, the suction belt 33 is driven and moved without conveying any sheets (a cleaning mode is started due to empty conveyance).

The cleaning member 60 slides on the lower surface of the suction belt 33 so as to remove paper particles, or the like, that adhere to the lower surface of the suction belt 33, and the paper particles, or the like, are drawn into the vacuum chamber 53. The paper particles, or the like, that have been drawn into the vacuum chamber 53 are collected in the paper-particle collecting device 55 via the vacuum duct 49 and the vacuum blower 54.

Next, it is determined whether a predetermined time (t second) elapses after the cleaning mode has been started (Step S14) and, if it is determined that the predetermined time (t second) elapses (YES at Step S14), the paper feed tray bottom plate 32*a* is lowered (Step S15). At the same time, the operations of the vacuum blower 54 and the suction belt 33 are stopped (Step S16), and the paper feed tray bottom plate 32*a* is returned to its initial position (Step S17). The predetermined time (t second) may be set to, for example, the time in which the suction belt 33 is moved any of one to ten revolutions.

As described above, in the present embodiment, cleaning of the suction belt 33 can be automatically performed each time a predetermined number (N) of sheets are supplied, whereby an unexpected occurrence of faulty images or sheet jam due to adhesion of paper particles, or the like, to the suction belt 33 can be prevented. Furthermore, the cleaning mode of the suction belt 33 is performed within a predetermined limited time; therefore, the power consumption of the drive motor 50 is hardly increased. Moreover, the number (N) of supplied sheets is appropriately set depending on the usage environment of a user; therefore, it is possible to obtain both printing productivity and maintenance of the conveying capability of the suction belt 33. As the suction belt 33 and the cleaning member 60 are abraded or degraded with time, the number (N) of supplied sheets may be gradually decreased with time so that the frequency at which cleaning is performed is gradually increased.

The degree of misalignment between the sheet and the suction belt 33 that suctions and conveys the sheet may be detected and, if the degree of misalignment is equal to or greater than a predetermined value, the cleaning mode of the suction belt 33 may be started. If paper particles, or the like, adhere to the suction belt 33, the misalignment between the suction belt 33 and the sheet easily occur due to slippage. That is, if the degree of misalignment is equal to or greater than a predetermined value, it is necessary to remove paper particles, or the like, from the suction belt 33.

Therefore, a comparison is made between the theoretically required time and the time it takes the sheet conveyed by the suction belt 33 to reach the sheet detection sensor 38. Specifically, a comparison is made between the actually required time and the theoretically required time that is calculated based on the rotating speed of the drive motor 50 of the suction belt 33, the rotating speed of the carriage roller 37, and the distance between the discharge end of the suction belt 33 and the sheet detection sensor 38. If the time it actually takes the sheet to reach the sheet detection sensor 38 is longer than the theoretically required time, there is a high possibility that the misalignment between the sheet and the suction belt 33 due to slippage occurs.

Figure 11A:
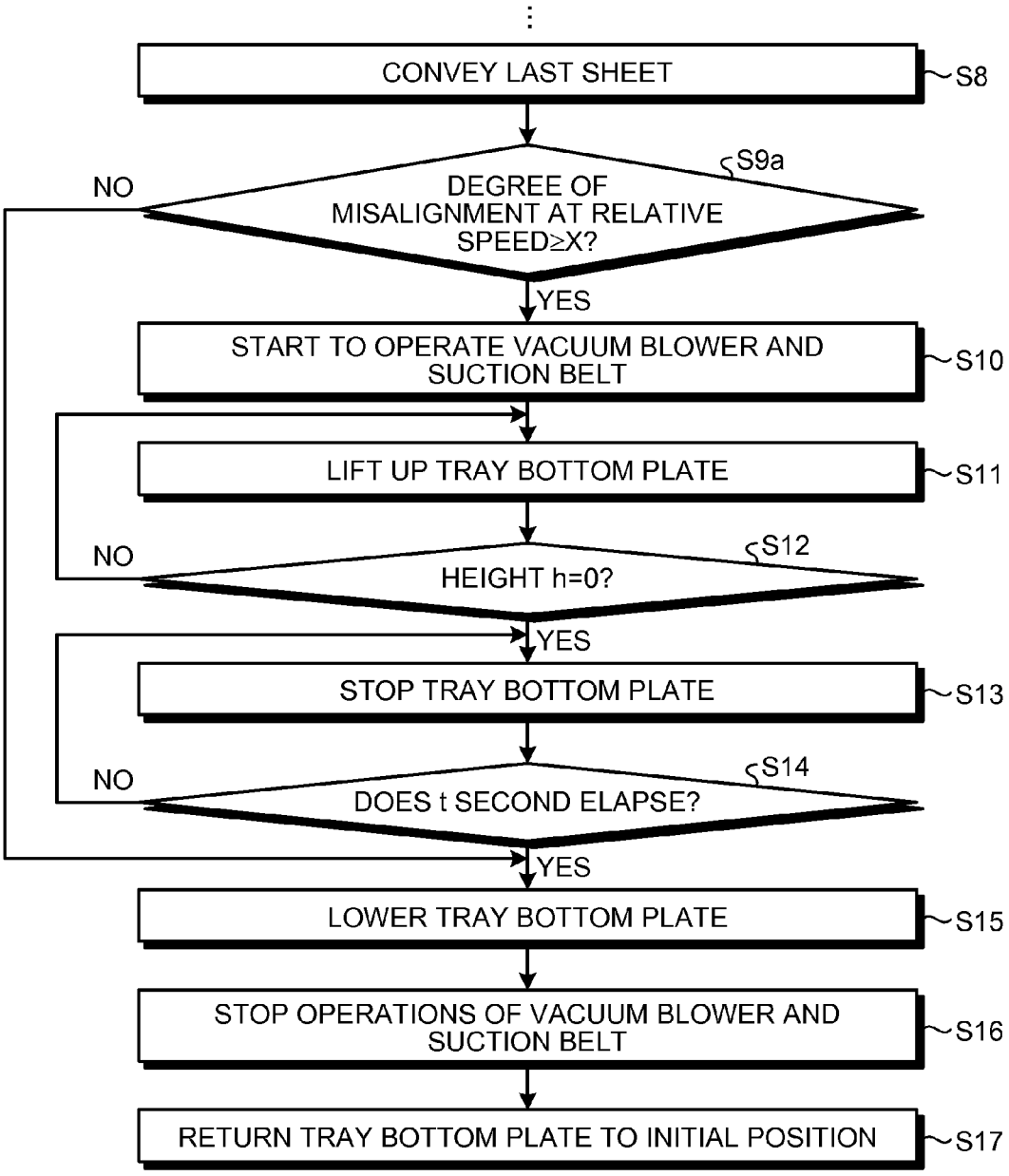
FIG. 11*a* is a modified example of the above-described flowchart.

FIG. 11*a* is a modified control example where the cleaning mode is started in accordance with the degree of misalignment. The control illustrated in FIG. 11*a* is the same as that of FIG. 11 except that Step S9 illustrated in FIG. 11 is replaced with Step S9*a*. In this modified control example, when the degree of misalignment at a relative speed is equal to or greater than a predetermined value (X), the cleaning mode is started at Step S10. As the cleaning mode is started at such a start timing, it is possible to minimize loss of the printing productivity and to maintain the conveyance force of the suction belt 33.

Figure 11B:
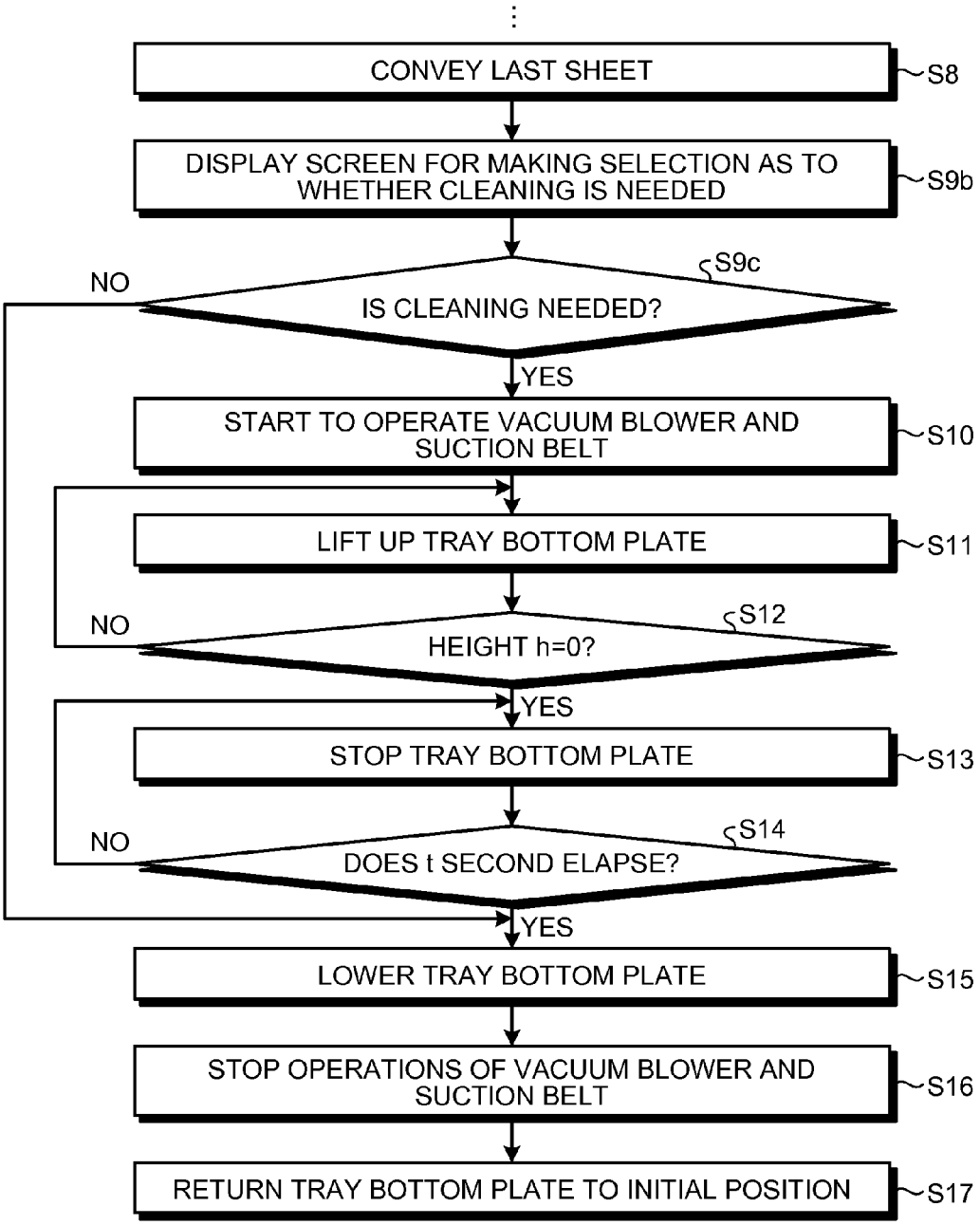
FIG. 11*b* is another modified example of the above-described flowchart.
Figure 12:
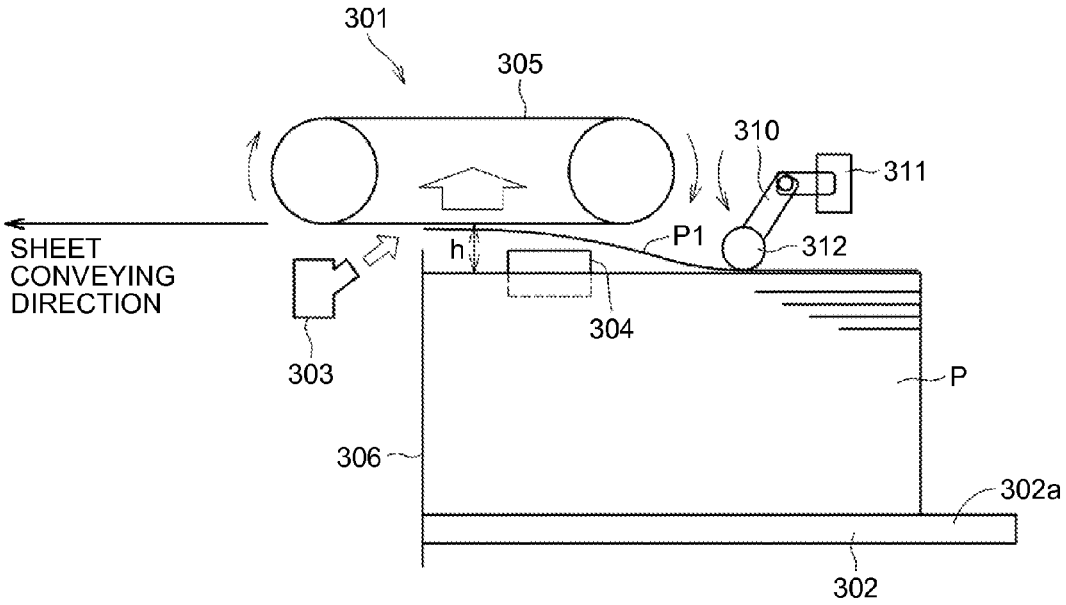
FIG. 12 is a schematic configuration diagram of a conventional air-separation feeding device.

It takes some time to clean the suction belt 33; therefore, in some cases, for example, in a case for urgent printing, priority needs to be given to the printing productivity over the cleaning. Therefore, the operation screen, or the like, of the image forming apparatus main body 2 displays a screen through which a user manually makes a selection as to whether or not cleaning of the suction belt 33 is needed, as illustrated in FIG. 11*b* (Step S9*b*).

If the user determines that "cleaning is needed" (YES at Step S9*c*), the cleaning mode is started at Step S10 that is described above. Conversely, if the user determines that "cleaning is not needed" (NO at Step S9*c*), the process proceeds to Step S15 without performing the cleaning mode at Steps S10 to S14, and the paper feed tray bottom plate 32*a* is returned to the initial position in the same manner as described above (Step S17). It is also convenient for a user to optionally select the cleaning mode if the user desires to postpone the time for replacing the suction belt 33 or the cleaning member 60.

The embodiment of the present invention is explained above; however, the present invention is not limited to the above-described embodiment, and it is obvious that various modifications may be made within the scope of the present invention. Furthermore, the feeding device according to the present invention may be installed in not only the color image forming apparatus illustrated in FIG. 1 but also black-and-white image forming apparatuses, other copiers, printers, facsimile machines, multifunction peripherals, or the like.

According to the present invention, without making major changes to conventional air-separation feeding devices, it is possible to clean a suction conveying unit in an easy manner, within a smaller space, and at lower costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device comprising:

a sheet placement unit configured to place sheets in stacked state thereon;

an air discharge unit configured to discharge air to the sheets so as to float a single sheet that is located at top of the sheets;

a suction conveying unit configured to suction, due to a negative pressure, the single floated sheet located at the top of the sheets and conveys the sheet;

an upper-surface position detection unit configured to be brought into contact with an uppermost surface of the sheets so as to detect a level of the uppermost surface;

a lifting and lowering unit configured to lift and lower the sheet placement unit in a vertical direction;

a control unit configured to control, in accordance with an uppermost surface position detected by the upper-surface position detection unit, the lifting and lowering unit such that a level of the uppermost surface of the sheets becomes a set level; and a cleaning member configured to remove paper particles, or the like, the cleaning member being mounted on a top edge of a front fence of the feeding device at a downstream side of a conveyance direction, wherein the suction conveying unit is driven in a state where the sheet placement unit is in contact with the suction conveying unit.

2. The feeding device according to claim 1, wherein the suction conveying unit includes a suction belt that is wrapped around a pair of rollers; and a vacuum chamber that is installed inside the suction belt, the suction conveying unit is configured to stick a sheet to an outer surface of the suction belt by drawing air into the vacuum chamber through a suction hole that is formed on the suction belt, and the cleaning member is brought into contact with the suction belt at a position between the rollers.

3. The feeding device according to claim 2, further comprising an accumulation unit configured to accumulate paper particles, or the like, removed from the suction conveying unit, the accumulation unit being installed on an exhaust air passage of air from the vacuum chamber.

4. The feeding device according to claim 3, wherein the accumulation unit is installed on the exhaust air passage downstream from the vacuum chamber.

5. The feeding device according to claim 2, wherein, while the cleaning member on the sheet placement unit is in contact with the suction conveying unit, air is drawn into the vacuum chamber through the suction hole formed on the suction belt.

6. The feeding device according to claim 1, wherein the cleaning member is installed in a replaceable manner.

7. The feeding device according to claim 1, wherein the control unit is configured to, after a last sheet is conveyed from the sheet placement unit, lift the sheet placement unit to a level where the sheet placement unit is in contact with the suction conveying unit.

8. The feeding device according to claim 7, further comprising a misalignment-degree detection unit configured to detect a degree of misalignment that occurs between the suction conveying unit and a sheet that is attached to and conveyed by the suction conveying unit, wherein when the degree of misalignment is detected by the misalignment-degree detection unit, the control unit is configured to lift the sheet placement unit to a level where the sheet placement unit is in contact with the suction conveying unit.

9. The feeding device according to claim 1, wherein the control unit is configured to, after all of the sheets of a set stacked on the sheet placement unit have been fed, lift the sheet placement unit to a level where the sheet placement unit is in contact with the suction conveying unit.

10. The feeding device according to claim 9, wherein the control unit is configured to change a number of sheets for the following set.

11. The feeding device according to claim 9, wherein the control unit is configured to gradually decrease a number of sheets for the following set.

12. The feeding device according to claim 9, wherein if a number of sheets having been fed is less than the set number, the sheet placement unit is caused to lower without contracting the sheet placement unit with the suction conveying unit.

13. The feeding device according to claim 1, wherein the control unit is configured such that, each time a last sheet is conveyed from the sheet placement unit, a user is able to make, via an operator control panel, a selection as to whether or not the sheet placement unit is lifted to a level where the sheet placement unit is in contact with the suction conveying unit.

14. The feeding device according to claim 1, wherein cleaning member is elastic.

15. The feeding device according to claim 1, wherein the cleaning member is at least one of a non-woven material, a brush, and a blade.

16. The feeding device according to claim 1, wherein the cleaning member is attached to the sheet placement unit by gluing or magnetic attraction.

17. The feeding device according to claim 1, wherein an opposing area of the suction conveying unit that is opposed to the cleaning member is formed of an elastic material or low-frictional material.

18. The feeding device according to claim 1, wherein the cleaning member protrudes above the sheet placement unit where the sheet placement unit is in contact with the suction conveying unit.

19. The feeding device according to claim 1, wherein the cleaning member is mounted on the sheet placement unit at a most downstream side of the conveyance direction of the sheet.

20. An image forming apparatus including a feeding device, wherein the feeding device comprises:

a sheet placement unit configured to place sheets in stacked state thereon;

an air discharge unit configured to discharge air to the sheets so as to float a single sheet that is located at top of the sheets;

a suction conveying unit configured to suction, due to a negative pressure, the single floated sheet located at the top of the sheets and conveys the sheet;

an upper-surface position detection unit configured to be brought into contact with an uppermost surface of the sheets so as to detect a level of the uppermost surface;

a lifting and lowering unit configured to lift and lower the sheet placement unit in a vertical direction;

a control unit configured to control, in accordance with an uppermost surface position detected by the upper-surface position detection unit, the lifting and lowering unit such that a level of the uppermost surface of the sheets becomes a set level; and a cleaning member configured to remove paper particles, or the like, the cleaning member being mounted on a top edge of a front fence of the feeding device at a downstream side of a conveyance direction, wherein the suction conveying unit is driven in a state where the sheet placement unit is in contact with the suction conveying unit.

* * * * *